US010173856B2

(12) United States Patent
Matsumoto

(10) Patent No.: US 10,173,856 B2
(45) Date of Patent: Jan. 8, 2019

(54) SHEET SUPPORTING APPARATUS AND IMAGE FORMING APPARATUS

(71) Applicant: CANON KABUSHIKI KAISHA, Tokyo (JP)

(72) Inventor: Yasuaki Matsumoto, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/727,021

(22) Filed: Oct. 6, 2017

(65) Prior Publication Data

US 2018/0111784 A1 Apr. 26, 2018

(30) Foreign Application Priority Data

Oct. 25, 2016 (JP) ..... 2016-208340

(51) Int. Cl.

| | |
|---|---|
| ***B65H 29/34*** | (2006.01) |
| ***B65H 31/22*** | (2006.01) |
| ***B65H 31/08*** | (2006.01) |
| ***B65H 1/04*** | (2006.01) |
| ***B65H 3/44*** | (2006.01) |

(52) U.S. Cl.

CPC ..... *B65H 31/22* (2013.01); *B65H 1/04* (2013.01); *B65H 3/446* (2013.01); *B65H 31/08* (2013.01); *B65H 2402/10* (2013.01); *B65H 2402/60* (2013.01); *B65H 2402/64* (2013.01); *B65H 2405/313* (2013.01); *B65H 2405/332* (2013.01); *B65H 2801/06* (2013.01)

(58) Field of Classification Search

CPC ..... B65H 2402/10; B65H 2402/60; B65H 2402/64

See application file for complete search history.

(56) References Cited

U.S. PATENT DOCUMENTS

| | | | | |
|---|---|---|---|---|
| 5,601,206 | A * | 2/1997 | Haas | B60R 9/00 16/254 |
| 6,540,268 | B2 * | 4/2003 | Pauser | A45C 13/06 220/243 |
| 7,007,948 | B2 | 5/2006 | Kamiya et al. | |
| 7,203,445 | B2 | 4/2007 | Uchida | |

(Continued)

FOREIGN PATENT DOCUMENTS

| | | |
|---|---|---|
| JP | 08030060 A | 2/1996 |
| JP | 09-090688 A | 4/1997 |

(Continued)

*Primary Examiner* — Howard J Sanders
(74) *Attorney, Agent, or Firm* — Venable LLP

(57) ABSTRACT

A sheet supporting apparatus includes first and second units. The first unit includes a first housing, first and second lock portions, a first shaft configured to be supported rotatably with respect to the first housing and to turnably support the first lock portion, and a second shaft configured to be supported rotatably with respect to the first housing and to turnably support the second lock portion. The second unit includes a second housing and first and second engagement portions provided in the second housing and configured to engage respectively with the first and second lock portions. The first and second shafts are disposed such that extension lines of rotational axes of the first and second shafts cross with each other in a plan view.

10 Claims, 8 Drawing Sheets

(56) References Cited

U.S. PATENT DOCUMENTS

| | | | | |
|---|---|---|---|---|
| 8,567,631 | B2 * | 10/2013 | Brunner | B25H 3/02 220/326 |
| 8,864,303 | B2 * | 10/2014 | Huang | B41J 29/13 347/108 |
| 9,260,262 | B2 | 2/2016 | Matsumoto et al. | |
| 2009/0122330 | A1 * | 5/2009 | Andoh | H04N 1/00525 358/1.13 |
| 2011/0242626 | A1 * | 10/2011 | Nagashima | G03G 15/60 358/498 |
| 2015/0130341 | A1 * | 5/2015 | Azami | G03G 21/1623 312/333 |

FOREIGN PATENT DOCUMENTS

| | | | |
|---|---|---|---|
| JP | 090900688 | A | 4/1997 |
| JP | 2005026795 | A | 1/2005 |
| JP | 2008209823 | A | 9/2008 |

* cited by examiner

SHEET SUPPORTING APPARATUS AND IMAGE FORMING APPARATUS

BACKGROUND OF THE INVENTION

Field of the Invention

The present disclosure relates to a sheet supporting apparatus configured to support a sheet and an image forming apparatus comprising the sheet supporting apparatus.

Description of the Related Art

In general, some image forming apparatus such as a printer is used in a state in which a plurality of attachable/detachable feed units is attached to the apparatus. For instance, there is a case where a second feed unit provided separately from an apparatus body of the image forming apparatus is attached to the apparatus body including a first feed unit. There is also a case where a plurality of feed units is attached to the apparatus body while being linked with each other. This arrangement makes it possible to increase a capacity of sheet stacking amount and to handle a printing job of a large volume.

In a case where a plurality of feed units is connected in a vertical direction, a height of the image forming apparatus increases, thus destabilizing the apparatus. Due to that, an image forming apparatus provided with a lock mechanism configured to lock feed units adjacent with each other by a plurality of latches is proposed as disclosed in Japanese Patent Application Laid-open No. 2005-26795 for example. This image forming apparatus is configured such that the plurality of latches disposed at corners on a diagonal line of the feed units can be locked/unlocked by manipulating one unlock lever.

However, the image forming apparatus as disclosed in Japanese Patent Application Laid-open No. 2005-26795 has such a possibility that all of the plurality of latches may be readily unlocked if an external force acts in a turning direction of the latches because axial directions of centers of turn of the plurality of latches run in parallel with each other. Still further, because the image forming apparatus is configured under such supposition that move directions of the plurality of latches are the same, a degree of freedom in terms of disposition of the plurality of latches is low, and there is a problem in terms of the degree of freedom of design.

SUMMARY OF THE INVENTION

According to a first aspect of the present invention, a sheet supporting apparatus configured to support a sheet includes a first unit including a first housing, first and second lock portions, a first shaft configured to be supported rotatably with respect to the first housing and to turnably support the first lock portion, and a second shaft configured to be supported rotatably with respect to the first housing and to turnably support the second lock portion, and a second unit including a second housing and first and second engagement portions provided in the second housing and configured to engage respectively with the first and second lock portions. The first lock portion being locked with the first engagement portion and the second lock portion being locked with the second engagement portion are unlocked along with movements of the first and second lock portions. The first and second shafts being disposed such that extension lines of rotational axes of the first and second shafts cross with each other in a plan view.

According to a second aspect of the present invention, a sheet supporting apparatus includes a first housing, a sheet supporting portion configured to be supported by the first housing and to support a sheet, first and second lock portions configured to engage with a second housing provided in parallel with the first housing, a first shaft configured to be rotatably supported by the first housing and to rotatably support the first lock portion, and a second shaft configured to be rotatably supported by the first housing and to rotatably support the second lock portion. The first housing being locked with the second housing is unlocked along with movements of the first and second lock portions. The first and second shafts being disposed such that extension lines of rotational axes of the first and second shafts cross with each other in a plan view.

Further features of the present invention will become apparent from the following description of exemplary embodiments with reference to the attached drawings.

DESCRIPTION OF THE EMBODIMENTS

First Embodiment

Overall Configuration

An image forming apparatus of a first embodiment will be described with reference to the drawings. The image forming apparatus of the present embodiment is a laser beam printer comprising an electro-photographic image forming portion. This printer forms an image on a sheet based on image information inputted from an external personal computer PC or image information read from a document. Here, the sheet refers to a recording medium such as a sheet of paper, paper of an envelope and others, a plastic film such as a sheet for an overhead projector (OHT), and a cloth.

Figure 1:
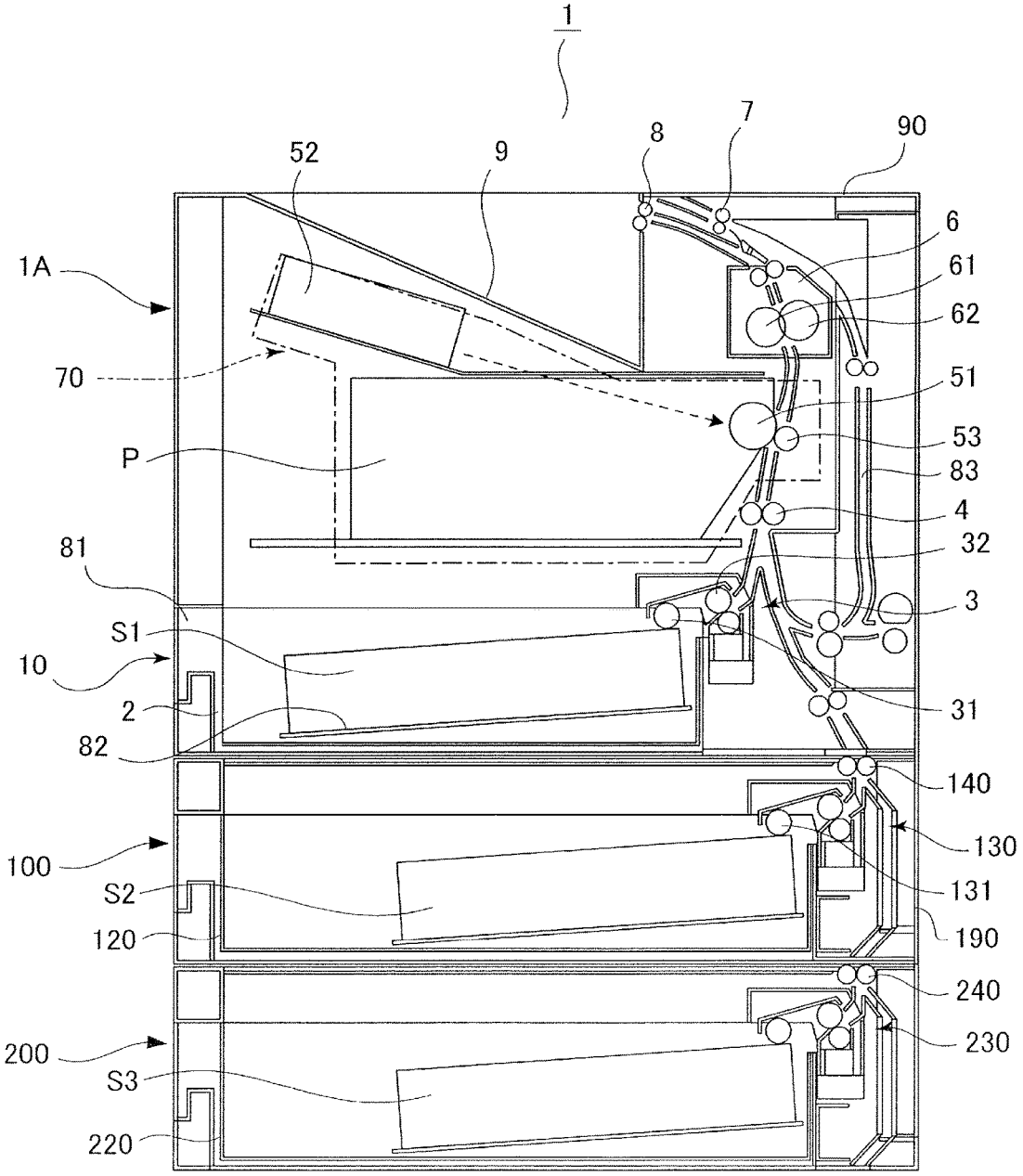
FIG. 1 is a schematic diagram illustrating an overall configuration of a printer of a first embodiment.

As illustrated in FIG. 1, a printer body 1A, i.e., an apparatus body of the printer 1, includes an image forming portion 70 and a sheet supporting portion 10 assembled into the printer body 1A. The sheet supporting portion 10 is provided with a feed portion 3 configured to feed a sheet S stored in a body cassette 81, i.e., the sheet supporting portion, to the image forming portion 70. The image forming portion 70 forms an image on the sheet S fed from the sheet supporting portion 10 or feed units 100 and 200 described later.

The image forming portion 70 includes a process cartridge P in which a photosensitive drum 51 and processing portions acting on the photosensitive drum 51 are integrated as a cartridge, a laser scanner 52 and a transfer roller 53. The process cartridge P is configured to be attachable/detachable to/from the printer body 1A so that it is replaced with new one when toner therein runs out.

In response to an input of a signal instructing to start to form an image, i.e., a printing job, to a controller not illustrated, the photosensitive drum 51 of the process cartridge P is rotationally driven to start an operation for forming a toner image, i.e., an image forming operation. A surface of the photosensitive drum 51 is homogeneously electrified by an electrifying unit and is then irradiated with a laser beam based on image information from a laser scanner 52 to form an electrostatic latent image. Then, the electrostatic latent image is visualized, i.e., developed, as a toner image by toner supplied from a developing unit to the photosensitive drum 51. The toner image formed on the photosensitive drum is transferred onto the sheet S at a transfer nip between the photosensitive drum 51 and the transfer roller 53 by the transfer roller 53 serving as a transfer unit.

In parallel with such image forming operation, the sheet supporting portion 10 starts to feed the sheet S. The feed portion 3 of the sheet supporting portion 10 includes the body cassette 81 disposed within the printer body 1A, a pickup roller 31 configured to feed the sheet S1, and a separation roller pair 32. The body cassette 81 is inserted into a housing 90 serving as a second housing of the printer body 1A such that an operator can draw out of the housing 90. The body cassette 81 further includes a sheet supporting plate 82 configured to support the sheet S and a spring not illustrated and configured to urge the sheet supporting plate 82 upward to keep an uppermost sheet S1 of a sheet bundle stacked on the sheet supporting plate 82 at a predetermined feed position.

The uppermost sheet S1 supported by the sheet supporting plate 82 is fed by the pickup roller 31 and is conveyed while being separated one by one by the separation roller pair 32. The sheet S1 separated by the separation roller pair 32 is conveyed to a registration roller pair 4 to correct a skew thereof and to the transfer nip in synchronism with an advance of the image forming operation in the process cartridge P.

The sheet S1 onto which the toner image has been transferred at the transfer nip is conveyed to a fixing unit 6. The fixing unit 6 includes a heating roller 61 heated by a ceramic heater or the like and a pressure roller 62 being in pressure contact with the heating roller 61 with a predetermined nip pressure. The toner image on the sheet S1 conveyed to the fixing unit 6 is fixed onto the sheet S1 by the heating roller 61 and the pressure roller 62.

In a case of simplex printing, the sheet S1 discharged out of the fixing unit 6 is conveyed to a discharge roller pair 8 and is stacked by the discharge roller pair 8 on a discharge tray 9 provided at an upper part of the printer body 1A. Meanwhile, in a case of duplex printing, the sheet S1 discharged out of the fixing unit 6 is conveyed to a reversing roller pair 7 and is then conveyed to a duplex conveyance path 83 by the reversing roller pair 7 that rotates inversely. Then, the sheet S1 is conveyed through the duplex conveyance path 83 to the image forming portion 70 again, and an image is formed on a back surface of the sheet S1. Then, the sheet S1 on which the images have been formed on both surfaces thereof is discharged by the discharge roller pair 8 to the discharge tray 9.

Feed Unit

Next, feed units 100 and 200 serving as a first unit optionally connected with the printer body 1A, i.e., a second unit, from an outside will be described. The feed unit 100 is configured to be able to connect with the housing 90 of the printer body 1A from downward and includes a cassette 120 serving as a sheet supporting portion configured to store a sheet S2 and a feed portion 130 configured to feed the sheet S2 stored in the cassette 120. The sheet S2 fed by the feed portion 130 is sent into the printer body 1A by a conveyance roller pair 140 to form an image thereon as described above.

The feed unit 200 is configured to be able to connect with a housing 190, i.e., a first housing, of the cassette 120 from downward and includes a cassette 220 configured to store a sheet S3 and a feed portion 230 configured to feed the sheet S3 stored in the cassette 220. The sheet S3 fed by the feed portion 230 is sent into the feed unit 100 by a conveyance roller pair 240 and is then sent into the printer body 1A to form an image thereon as described above.

As described above, the feed units 100 and 200 are connected in a manner layered to the printer body 1A and enable to increase an amount of sheets that can be stored within the printer. It is noted that a number of optional feed units is not limited to be two, and three or more feed units can be layered. The printer body 1A may be further placed on a top surface of the layered feed units. Still further, because configurations of the feed units 100 and 200 are same and configurations of the feed portions 130 and 230 included respectively in the feed units 100 and 200 are same with that of the feed portion 3 of the printer body 1A, their description will be omitted here.

Figure 2:
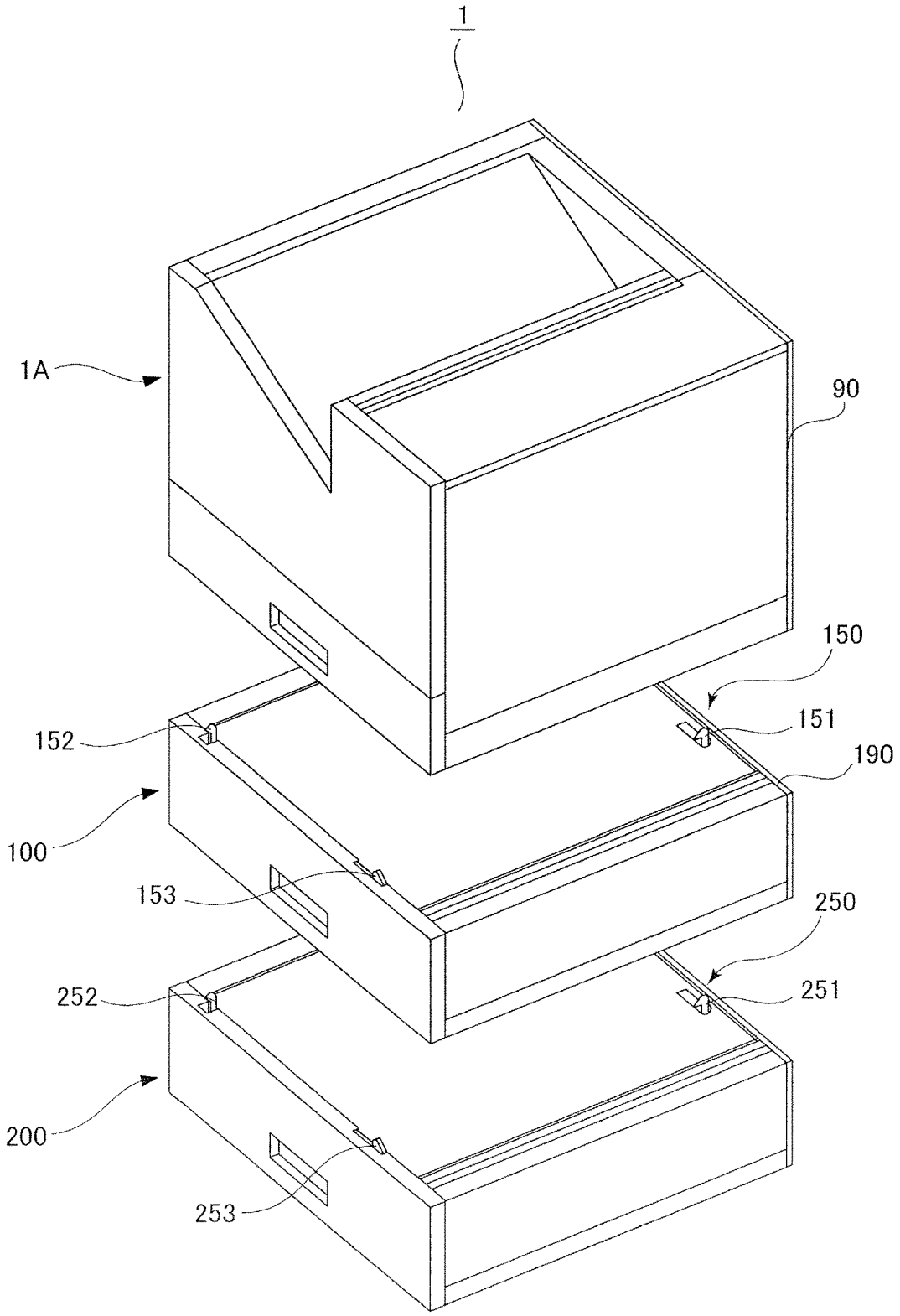
FIG. 2 is an exploded perspective view illustrating a printer body and a feed unit.

As illustrated in FIG. 2, the feed units 100 and 200 are configured to be attachable/detachable to the printer body 1A or the other feed unit and include lock mechanisms 150 and 250 having an identical structure. The lock mechanism 150 includes a first lock member 151, a second lock member 152 and a lock lever 153 disposed respectively at diagonal positions of the feed unit 100. The first and second lock members 151 and 152 are configured to turn together with a turning operation of the lock lever 153 as described later so as to be able to lock or unlock the feed unit 100 to/from the printer body 1A.

In the same manner, the lock mechanism 250 includes a first lock member 251, a second lock member 252 and a lock lever 253 disposed respectively at diagonal positions of the feed unit 200. The first and second lock members 251 and 252 are configured to turn together with a turning operation of the lock lever 253 so as to be able to lock or unlock the feed unit 200 to/from the feed unit 100.

Because these lock mechanisms 150 and 250 have the same structure, only the lock mechanism 150 configured to be able to connect the printer body 1A with the feed unit 100 will be described, and a description of the lock mechanism 250 of the feed unit 200 will be omitted here. It is noted that the sheet supporting apparatus may be composed of only the feed unit 100, the printer body 1A and the feed unit 100, or the feed units 100 and 200.

Configuration of Lock Mechanism

Figure 3:
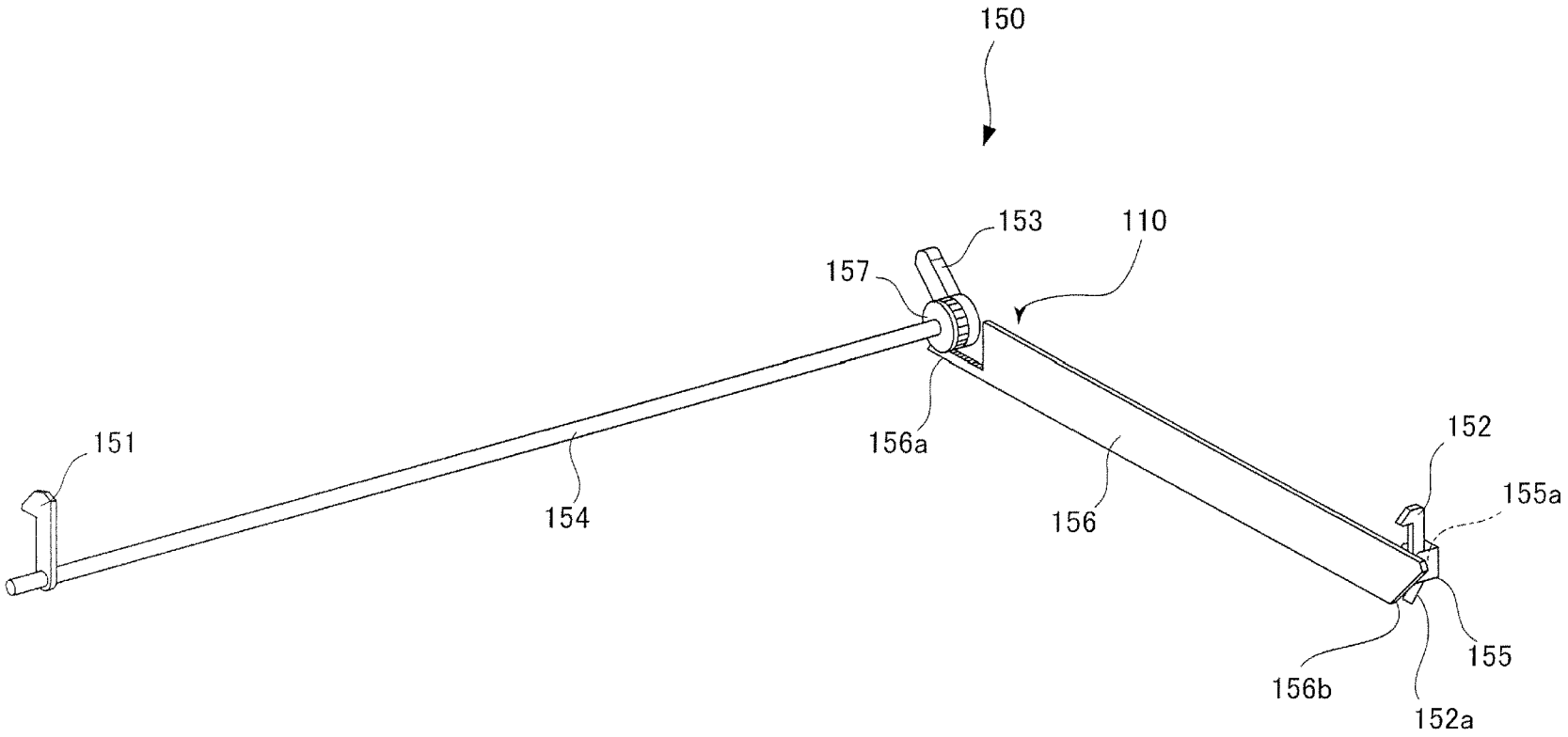
FIG. 3 is a perspective view illustrating a lock mechanism.

As illustrated in FIG. 3, the lock mechanism 150 includes the first lock member 151 serving as a first lock portion, the second lock member 152 serving as a second lock portion, the lock lever 153, and an interlock mechanism 110 configured to interlock the first and second lock members 151 and 152. The lock mechanism 150 also includes a first shaft 154 and a second shaft 155*a* rotatably supported with respect to the housing 190 (see FIG. 2) and a holding member 155 turnably supporting the second lock member 152 through the second shaft 155*a*. It is noted that while the second shaft 155*a* is formed in a body with the holding member 155 in the present embodiment, they may be separated and the second shaft 155*a* may be formed in a body with the second lock member 152.

The first lock member 151 is fixed at one end of the first shaft 154, and the lock lever 153 serving as an operation portion that rotates in a body with the first lock member 151 is fixed at another end of the first shaft 154. The interlock mechanism 110 includes a pinion gear 157 serving as a gear portion fixed to the first shaft 154 and a slide member 156 serving as a move portion on which a rack 156*a* engaging with the pinion gear 157 is formed. The slide member 156 is movable in a move direction in parallel with an axial direction of the second shaft 155*a* as the pinion gear 157 rotates and is formed thinly along an extension line of a rotational axis of the second shaft 155*a*.

A pressure surface 156*b* configured to be able to press a contact portion 152*a* of the second lock member 152 is formed at an end of the slide member 156 opposite from the rack 156*a*. The pressure surface 156*b* is inclined in the move direction of the slide member 156, i.e., is inclined specifically upward in a direction distant from the pinion gear 157. While the first shaft 154 and the second shaft 155*a* are formed such that extension lines of their rotational axes are orthogonal from each other in a plan view in the present embodiment, they are not limited to be orthogonal unless they are in parallel with each other. That is, the extension lines of the rotational axes of the first shaft 154 and the second shaft 155*a* are just required to cross with each other.

Operation of Lock Mechanism

Next, an operation of the lock mechanism 150 will be described with reference to FIGS. 4A, 4B, 5A and 5B. It is noted that FIGS. 4A and 4B illustrate the lock mechanism 150 positioned at an unlock position where the feed unit 100 is not locked to the printer body 1A, and FIGS. 5A and 5B illustrate the lock mechanism 150 positioned at a lock position where the feed unit 100 is locked to the printer body 1A.

Figure 4A:
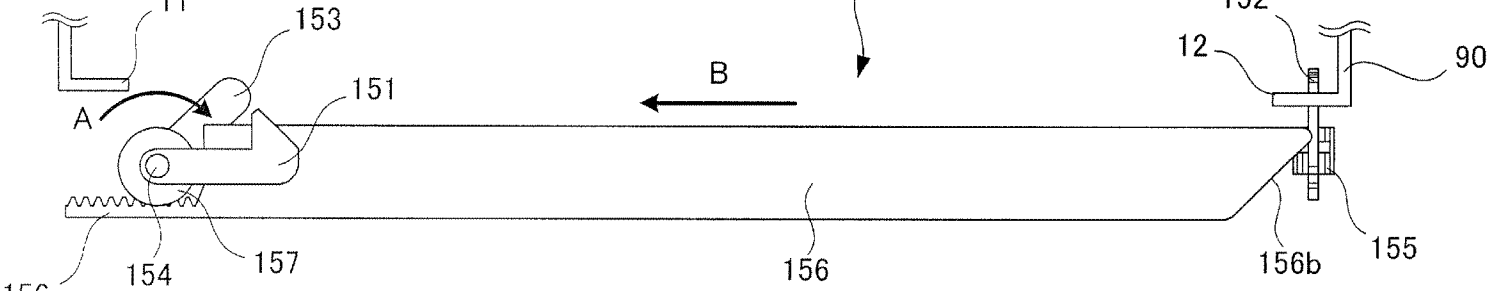
FIG. 4A is a side view of the lock mechanism positioned at an unlock position viewed from an axial direction of a first shaft.
Figure 4B:
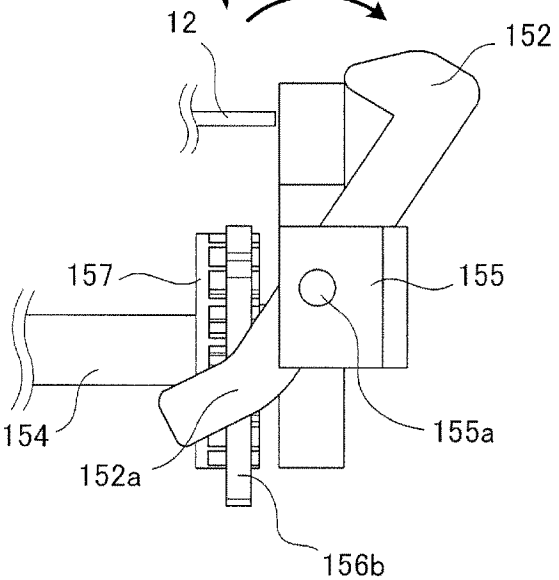
FIG. 4B is a side view of the lock mechanism positioned at the unlock position viewed from an axial direction of a second shaft.

As illustrated in FIG. 4A, the first lock member 151 is separated in a direction of an arrow A from a first lock plate 11 of the housing 90 of the printer body 1A provided in parallel with the housing 190 in the condition in which the lock mechanism 150 is positioned at the unlock position. Still further, the second lock member 152 is separated in a direction of an arrow C from a second lock plate 12 of the housing 90 of the printer body 1A as illustrated in FIG. 4B. At this time, the second lock member 152 is in contact with a holding member 155, so that a turning angle of the lock lever 153 is limited.

The first and second lock members 151 and 152 have a shape of a hook configured to engage respectively with the first and second lock plates 11 and 12, and the contact portion 152*a* is formed on a side opposite from the hook with respect to the second shaft 155*a* of the second lock member 152. While the first and second lock plates 11 and 12 formed on the housing 90 of the printer body 1A and serving as first and second engagement portions are not limited in terms of a shape or a material thereof, they are formed as an edge of a hole perforated through a bottom surface of the housing 90 for example. The first and second lock plates 11 and 12 are provided also on bottom surfaces of housings of the feed units 100 and 200 to be used in locking the feed units with each other.

Figure 5A:
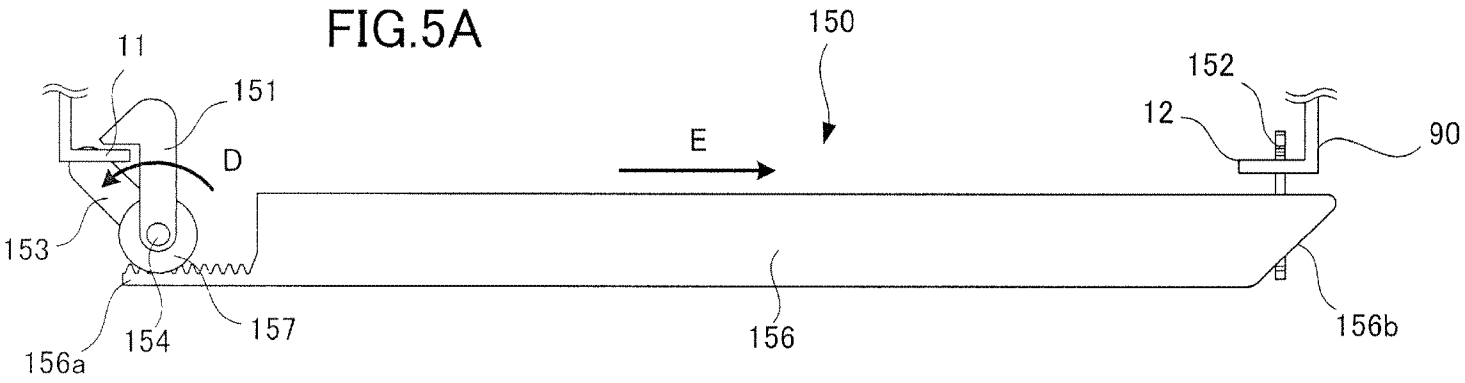
FIG. 5A is a side view of the lock mechanism positioned at a lock position viewed from the axial direction of the first shaft.
Figure 5B:
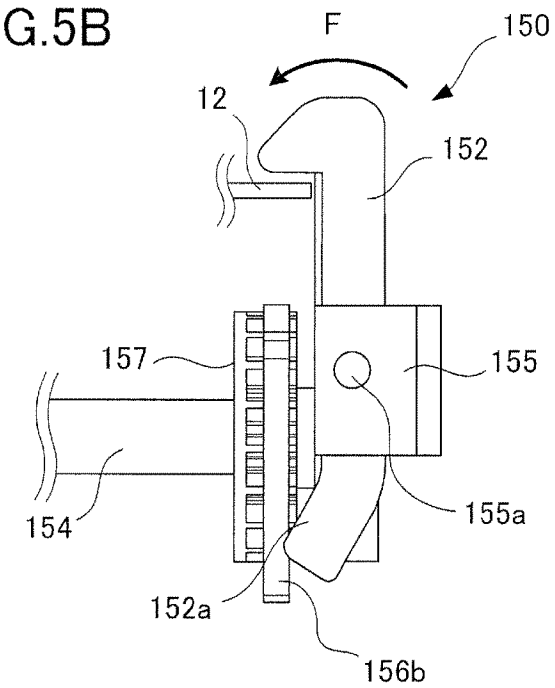
FIG. 5B is a side view of the lock mechanism positioned at the lock position viewed from the axial direction of the second shaft.

When the lock lever 153 is turned in this condition, the lock mechanism 150 moves from the unlock position to the lock position as illustrated in FIG. 5A. The first lock member 151 configured to rotate together with the lock lever 153 through the first shaft 154 turns in a direction of an arrow D and comes into contact with the first lock plate 11.

Still further, the rack 156*a* is slid and moved by the pinion gear 157 which rotates together with the lock lever 153 through the first shaft 154. The slide member 156 moves in a direction of an arrow E. At this time, the pressure surface 156*b* of the slide member 156 presses a top surface of the contact portion 152*a* of the second lock member 152 from the move direction in parallel with the second shaft 155*a* as illustrated in FIG. 5B. Because the pressure surface 156*b* is inclined upward, the contact portion 152*a* of the second lock member 152 is pressed downward along with the move of the slide member 156 in the direction of the arrow E. Thereby, the second lock member 152 comes into contact with the second lock plate 12.

It is noted that the second lock member 152 is formed such that the top surface of the contact portion 152*a* thereof is located at height between upper and lower end portions of the pressure surface 156*b* in the condition in which the lock mechanism 150 is positioned at the unlock position. The contact portion 152*a* overlaps with the pressure surface 156*b* in the axial direction of the first shaft 154. Such disposition makes it possible to reliably press the contact portion 152*a* by the pressure surface 156*b* and to turn the second lock member 152 when the slide member 156 slides and moves.

It is possible to move the lock mechanism 150 from the unlock position to the lock position and to lock the feed unit 100 to the printer body 1A by the first and second lock members 151 and 152 by turning the lock lever 153 configured as described above. In contrary, in a case of unlocking the feed unit 100 from the printer body 1A, i.e., in a case of releasing the engage condition, it is possible to move the lock mechanism 150 from the lock position to the unlock position just by turning the lock lever 153 inversely. That is, the first lock member 151 moves in the direction of the arrow A as illustrated in FIG. 4A and the second lock member 152 turns in the direction of the arrow C as illustrated in FIG. 4B. Thus, the feed unit 100 is unlocked from the printer body 1A.

It is thus possible to lock the first and second lock members 151 and 152 simultaneously just by manipulating the lock lever 153. This arrangement makes it possible to reduce an operational burden of the user and to prevent the lock from being forgotten to be locked. Still further, because the extension lines of the rotational axes of the first and second shafts 154 and 155*a* are orthogonal with each other in a plan view, lock directions of the first and second lock members 151 and 152 are different.

That is, the first lock member 151 restricts the feed unit 100 from moving in width and height directions with respect to the printer body 1A for example. The second lock member 152 restricts the feed unit 100 from moving in a depth direction orthogonal to the width direction and in the height direction with respect to the printer body 1A. Therefore, even if an external force is applied to the printer body 1A from any direction of the width and the depth directions, the force is dispersed and the lock mechanism 150 is hardly unlocked because the turning directions of the first and second lock members 151 and 152 are different. Accordingly, the feed unit 100 can be stably connected with the printer body 1A.

Still further, because the turning directions of the first and second lock members 151 and 152 are not limited, a degree of freedom of design can be improved. Because the lock mechanism 150 is configured so as to interlock by the simple structure of the rack and pinion, a number of components can be reduced, thus lowering a cost of the apparatus.

Second Embodiment

Next, a second embodiment of the present disclosure will be described. The second embodiment is what the lock mechanism of the first embodiment is realized by a different configuration. Accordingly, same components with those of the first embodiment will not be illustrated or will be described by denoting the same reference numerals in the drawings.

Configuration of Lock Mechanism

Figure 6:
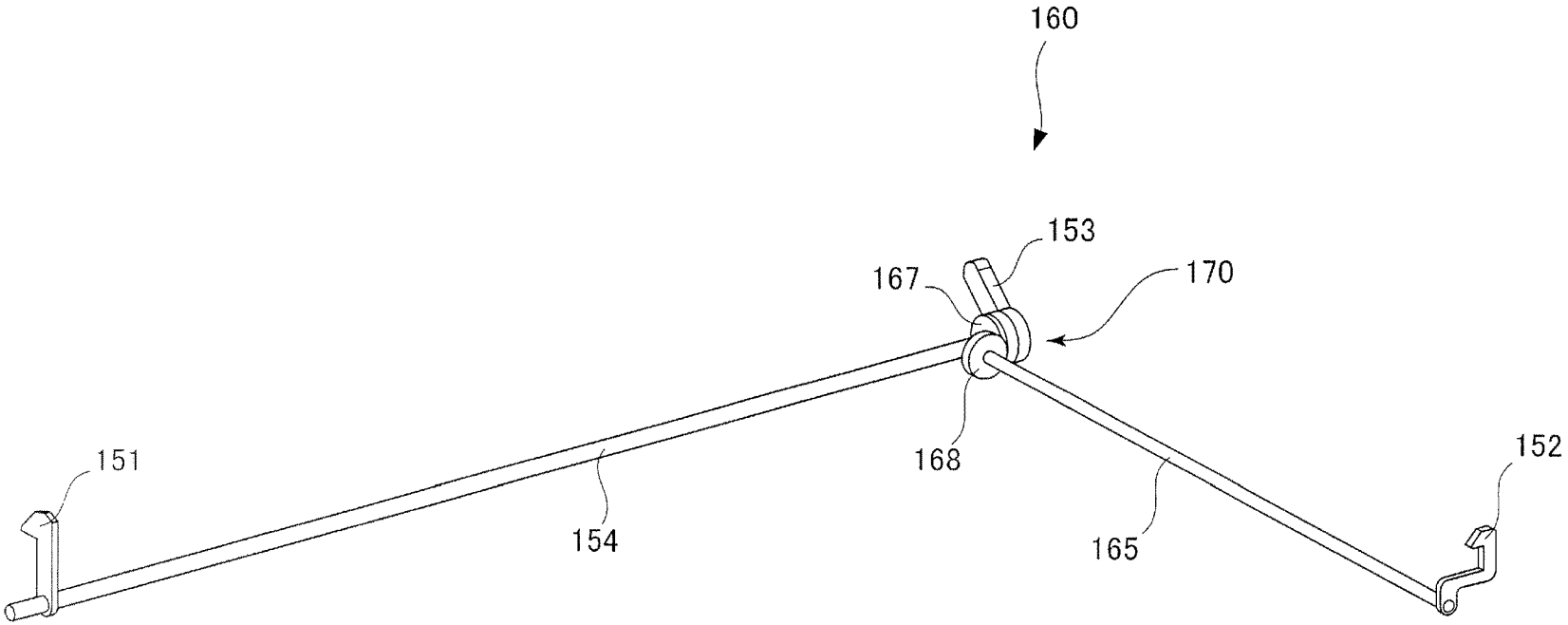
FIG. 6 is a perspective view illustrating a lock mechanism of a second embodiment.

As illustrated in FIG. 6, a lock mechanism 160 includes the first lock member 151, the second lock member 152, the lock lever 153, an interlock mechanism 170, the first shaft 154 and a second shaft 165. The interlock mechanism 170 includes a bevel gear 167 serving as a first gear portion fixed at an end of the first shaft 154 opposite from the first lock member 151 and a bevel gear 168 serving as a second gear portion engaging with the bevel gear 167. The bevel gear 168 is fixed at one end of the second shaft 165, and the second lock member 152 is fixed at another end of the second shaft 165. The bevel gear 167 includes a plurality of teeth inclined with respect to an axial direction of the first shaft 154, and the bevel gear 168 includes a plurality of teeth inclined with respect to an axial direction of the second shaft 165. It is possible to transmit a rotational drive of the first shaft 154 to the second shaft 165 orthogonal to the axial direction of the first shaft 154 by the engagement of these bevel gears 167 and 168.

Operation of Lock Mechanism

Next, an operation of the lock mechanism 160 will be described with reference to FIGS. 7 and 8. It is noted that FIGS. 7A and 7B illustrate the lock mechanism 160 located at the unlock position by which the feed unit 100 is not locked to the printer body 1A, and FIGS. 8A and 8B illustrate the lock mechanism 160 located at the lock position by which the feed unit 100 is locked to the printer body 1A.

Figure 7A:
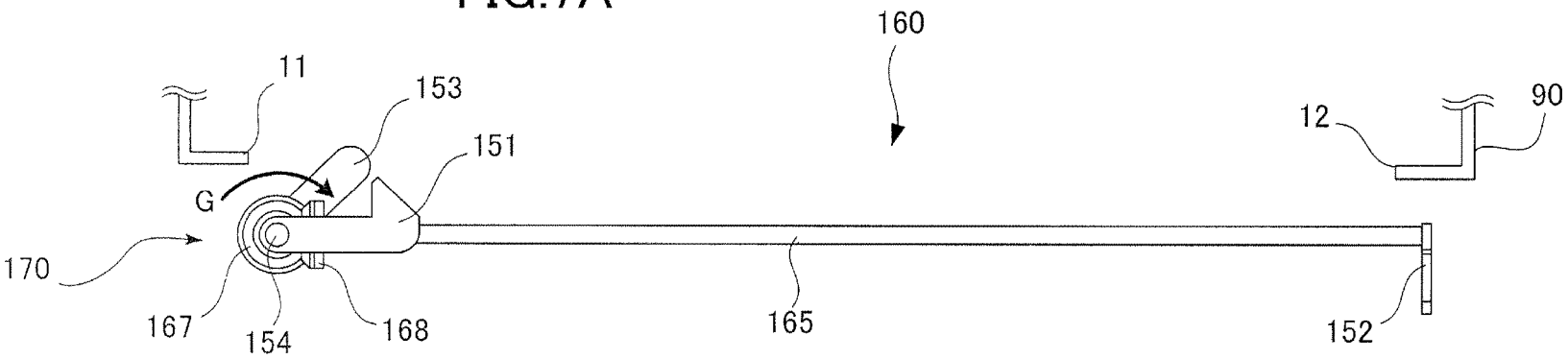
FIG. 7A is a side view of the lock mechanism of the second embodiment positioned at an unlock position viewed from the axial direction of the first shaft.
Figure 7B:
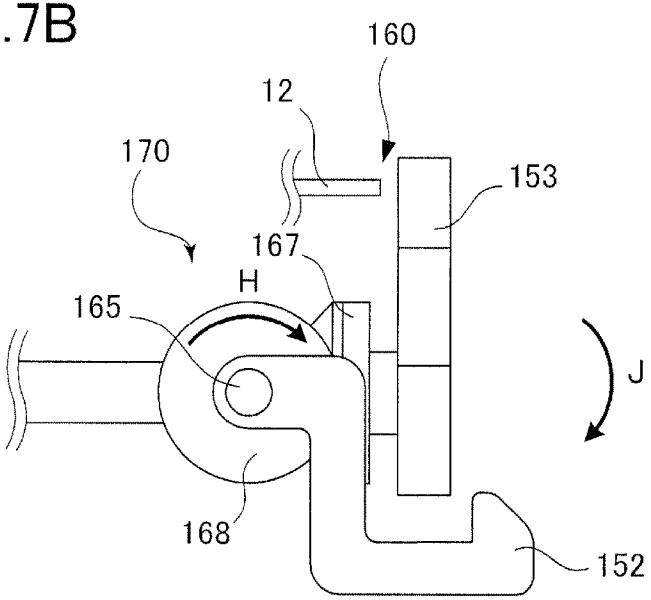
FIG. 7B is a side view of the lock mechanism of the second embodiment positioned at the unlock position viewed from the axial direction of the second shaft.

As illustrated in FIG. 7A, in a condition in which the lock mechanism 160 is located at the unlock position, the first lock member 151 is separated in a direction of an arrow G from the first lock plate 11 of the housing 90 of the printer body 1A. As illustrated in FIG. 7B, the second lock member 152 is separated in a direction of an arrow H from the second lock plate 12 of the housing 90 of the printer body 1A.

Figure 8A:
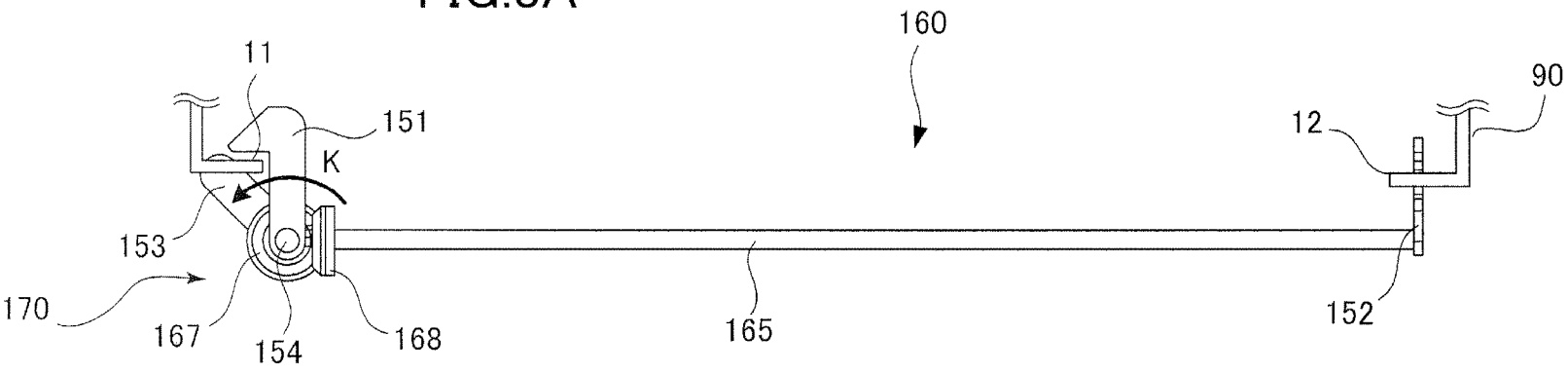
FIG. 8A is a side view of the lock mechanism of the second embodiment positioned at a lock position viewed from the axial direction of the first shaft.

When the lock lever 153 is manipulated and turned from this condition, the lock mechanism 160 moves from the unlock position to the lock position as illustrated in FIG. 8A. Along with the manipulation (movement) to the lock lever, the first lock member 151 that rotates together with the lock lever 153 through the first shaft 154 turns in a direction of an arrow K and comes into contact with the first lock plate 11.

Figure 8B:
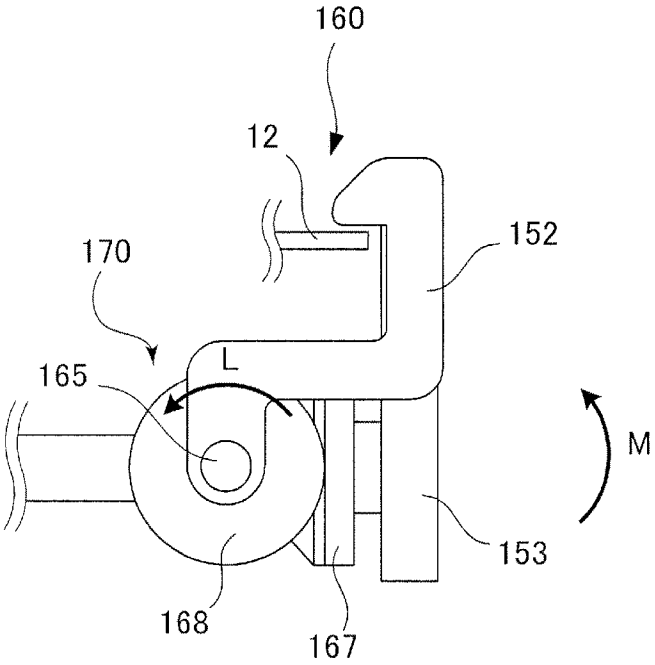
FIG. 8B is a side view of the lock mechanism of the second embodiment positioned at the lock position viewed from the axial direction of the second shaft.

Still further, as illustrated in FIG. 8B, because the bevel gear 167 that rotates together with the lock lever 153 through the first shaft 154 engages with the bevel gear 168 fixed to the second shaft 165, the second lock member 152 turns in a direction of an arrow M and comes into contact with the second lock plate 12.

It is possible to move the lock mechanism 160 from the unlock position to the lock position and to lock the feed unit 100 to the printer body 1A by the first and second lock members 151 and 152 by turning the lock lever 153 as described above. In a case of unlocking the feed unit 100 from the printer body 1A in contrary, it is possible to move the lock mechanism 160 from the lock position to the unlock position by turning the lock lever 153 inversely. That is, the first lock member 151 turns in the direction of the arrow G as illustrated in FIG. 7A and the second lock member 152 turns in the direction of the arrow J as illustrated in FIG. 7B. Thus, the feed unit 100 is unlocked from the printer body 1A.

It is possible to lock the first and second lock members 151 and 152 simultaneously by manipulating the lock lever 153 as described above. This arrangement makes it possible to reduce an operational burden of the user and to prevent the lock from being forgotten to be locked. Still further, because the extension lines of rotational axes of the first shaft 154 and the second shaft 155*a* are orthogonal to each other in a plan view, the lock directions of the first and second lock members 151 and 152 are different.

Therefore, even if an external force is applied to the printer body 1A from any directions of the width direction and the depth direction, the force is dispersed because the turning directions of the first and second lock members 151 and 152 are different, and the lock of the lock mechanism 160 is hardly unlocked. Accordingly, the feed unit 100 can be stably connected with the printer body 1A. Still further, because the turning directions of the first and second lock members 151 and 152 are not limited, a degree of freedom of design can be improved. Still further, because the lock mechanism 160 is configured to interlock by the simple structure of the bevel gear mechanism, a number of components can be reduced, thus lowering the cost of the apparatus.

Other Embodiment

While the sheet supporting apparatus of the present disclosure has been described by using the electro-photographic printer 1 in the embodiments described above, the present disclosure is not limited to such cases. For instance, it is possible to apply the present disclosure to an ink-jet type image forming apparatus configured to form an image on a sheet by discharging ink droplets from a nozzle.

Still further, the lock lever 153 may be provided with a spring for example to urge the lock mechanism to the lock position. This arrangement makes it possible to connect the feed unit 100 to the printer body 1A more stably.

It is noted that while the lock lever 153 is fixed to the first shaft 154 in the first embodiment, the lock lever 153 may be fixed to the pinion gear 157 that rotates together with the first shaft 154. The first lock member 151 may be interlocked with the second lock member 152 not only by the interlock mechanism of the either embodiment described above but also by another interlock mechanism such as a wire and a link mechanism.

Still further, while the lock mechanisms 150 and 160 described in the first and second embodiments are provided in the feed unit 100, the present disclosure is not limited to such case. For instance, the lock mechanisms 150 and 160 may be provided in the printer body 1A and the first and second lock plates 11 and 12 may be provided in the feed unit 100.

The lock mechanisms 150 and 160 are not limited to be applicable only to the feed unit 100 and may be applicable to another unit. For instance, the lock mechanisms 150 and 160 may be applied to a reading unit configured to read an image of a document, to a finisher executing various post-processing such as stapling, and to a stacking unit on which the sheet discharged out of the printer body 1A is stacked.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-208340, filed Oct. 25, 2016, which is hereby incorporated by reference wherein in its entirety.

What is claimed is:

1. A sheet supporting apparatus configured to support a sheet, the sheet supporting apparatus comprising:

a first unit including a first housing, first and second lock portions, a first shaft configured to be supported rotatably with respect to the first housing and to turnably support the first lock portion, and a second shaft configured to be supported rotatably with respect to the first housing and to turnably support the second lock portion;

a second unit including a second housing and first and second engagement portions provided in the second housing and configured to engage respectively with the first and second lock portions; and an interlock mechanism configured to interlock the first and second lock portions, the interlock mechanism comprising:

a gear portion rotating together with the first lock portion; and a move portion including a rack portion engaging with the gear portion and a pressure surface configured to press the second lock portion and configured to move in a move direction in parallel with the second shaft, the pressure surface being configured to press the second lock portion from the move direction by the move portion that moves in the move direction, wherein the first lock portion being locked with the first engagement portion and the second lock portion being locked with the second engagement portion are unlocked along with movements of the first and second lock portions, and the first and second shafts are disposed such that extension lines of rotational axes of the first and second shafts cross with each other in a plan view.

2. The sheet supporting apparatus according to claim 1, wherein the extension lines of rotational axes of the first and second shafts are orthogonal to each other in a plan view.

3. The sheet supporting apparatus according to claim 1, wherein the pressure surface is inclined in the move direction.

4. The sheet supporting apparatus according to claim 1, further comprising a manipulating portion configured to turn in a body with the first lock portion.

5. The sheet supporting apparatus according to claim 1, wherein the first unit includes a sheet supporting portion configured to be supported by the first housing and to support a sheet and a feed portion configured to feed the sheet supported by the sheet supporting portion.

6. An image forming apparatus, comprising:

the sheet supporting apparatus as set forth in claim 1; and an image forming portion provided in the second unit and configured to form an image on a sheet.

7. A sheet supporting apparatus configured to support a sheet, the sheet supporting apparatus comprising:

a first unit including a first housing, first and second lock portions, a first shaft configured to be supported rotatably with respect to the first housing and to turnably support the first lock portion, and a second shaft configured to be supported rotatably with respect to the first housing and to turnably support the second lock portion;

a second unit including a second housing and first and second engagement portions provided in the second housing and configured to engage respectively with the first and second lock portions; and an interlock mechanism configured to interlock the first and second lock portions, the interlock mechanism comprising:

a first gear portion configured to rotate together with the first lock portion and having a plurality of teeth inclined with respect to an axial direction of the first shaft, and a second gear portion engaging with the first gear portion, rotating together with the second lock portion and having a plurality of teeth inclined with respect to an axial direction of the second shaft, wherein the first lock portion being locked with the first engagement portion and the second lock portion being locked with the second engagement portion are unlocked along with movements of the first and second lock portions, and the first and second shafts are disposed such that extension lines of rotational axes of the first and second shafts cross with each other in a plan view.

8. The sheet supporting apparatus according to claim 7, wherein the first gear portion is fixed at an end of the first shaft opposite from the first lock portion, and the second gear portion is fixed at an end of the second shaft opposite from the second lock portion.

9. The sheet supporting apparatus according to claim 7, wherein the first unit includes a sheet supporting portion configured to be supported by the first housing and to support a sheet and a feed portion configured to feed the sheet supported by the sheet supporting portion.

10. An image forming apparatus, comprising:

the sheet supporting apparatus as set forth in claim 7; and an image forming portion provided in the second unit and configured to form an image on a sheet.

* * * * *